US006224225B1

(12) United States Patent
Chen

(10) Patent No.: US 6,224,225 B1
(45) Date of Patent: May 1, 2001

(54) MOBILE PHONE IN-CALL INDICATOR WITH ROTATABLY ADJUSTABLE ORNAMENTAL COVER

(76) Inventor: Hsiu-Nu Chen, 1F, No. 1, Alley 15, Lane 126, Xin Chun Street, Tanshui, Hsien (TW)

( * ) Notice: Subject to any disclaimer, the term of this patent is extended or adjusted under 35 U.S.C. 154(b) by 0 days.

(21) Appl. No.: 09/447,308

(22) Filed: Nov. 23, 1999

(51) Int. Cl.[7] ..... H01Q 1/06

(52) U.S. Cl. ..... 362/88; 362/109; 362/119; 362/253; 362/457; 362/458; 343/721

(58) Field of Search ..... 362/109, 119, 362/253, 88, 457, 458, 800; 343/721; 53/301

(56) References Cited

U.S. PATENT DOCUMENTS 6,039,459 * 3/2000 Chang ..... 362/253

* cited by examiner

*Primary Examiner*—Thomas M. Sember
*Assistant Examiner*—Ismael Negron
(74) *Attorney, Agent, or Firm*—Rosenberg, Klein & Lee

(57) ABSTRACT

A mobile phone in-call indicator for connecting to an antenna of a mobile phone is provided. The in-call indicator mainly includes a lower base having a lower bolt part and an externally threaded head, an upper base screwed to the threaded head of the lower base and having a light-emitting diode and a circuit board mounted thereto, and an ornamental cover rotatably fitted around the upper base to cover the upper base. In case the in-call indicator is mounted onto the mobile phone with the ornamental cover facing toward a direction not exactly the same as that of the mobile phone and therefore resulting in an inconsistent appearance, the cover may be adjusted in its direction simply by separating the upper base from the lower base and turn the upper base relative to the cover.

1 Claim, 3 Drawing Sheets

MOBILE PHONE IN-CALL INDICATOR WITH ROTATABLY ADJUSTABLE ORNAMENTAL COVER

BACKGROUND OF THE INVENTION

Mobile phones are now very popular among the general consumers to provide convenient communications. The mobile phones even have been classified by differently shaped appearances, such as cute model, streamline model, avant-garde model, etc., to meet the consumers' demands. To meet the diversified appearances of mobile phones, many peripheral equipment and/or parts of mobile phones, such as the antenna thereof, are also uniquely designed.

Some of the commercially available mobile phones are so designed that the antennas thereof are removed and replaced by light-emitting antenna heads A to indicate in-calls by emitting light. FIG. 1 illustrates an example of such light-emitting antenna head A. As shown, the antenna head A includes a base A1 on which a light-emitting diode A4 and a circuit board A5 are mounted, and a simple cover A3 in general geometrical shape for housing the base A1 and the light-emitting diode A4 and the circuit board A5. The base A1 has an integrally formed lower bolt A2 for directly screwed onto a mobile phone B. Whereby, when the mobile phone B receives any in-coming call, the antenna head A emits light to indicate an in-call. Such light-emitting antenna head A creates a visual entertainment for users and is widely welcomed by general consumers. And, the covers A3 originally having only simple geometrical shapes are now changeful in shape to meet different consumer demands.

The differently shaped covers A3 are fixedly connected to the bases A1 during manufacture. Consumers select the antenna head A showing their most favorite design and directly screw the antenna head A to the mobile phone B.

A problem found with these differently shaped antenna heads A is the cover A3 might not be consistent with the mobile phone B in their facing direction after the antenna head A has been fully screwed onto the mobile phone B. Some of the angularly deviated antenna heads A even make the mobile phones B looking ugly. This is because forces applied to screw the antenna heads A to the mobile phones B vary with users. It is therefore tried by the inventor to develop an improved light-emitting in-call indicator to eliminate the drawbacks existing in the conventional antenna heads.

SUMMARY OF THE INVENTION

A primary object of the present invention is to provide a mobile phone in-call indicator that does not have the problem of an angularly deviated cover to spoil an integral appearance of the mobile phone.

To achieve the above and other objects, the mobile phone in-call indicator of the present invention mainly includes a lower base having a lower bolt part and an externally threaded head, an upper base screwed to the threaded head of the lower base and having a light-emitting diode and a circuit board mounted thereto, and an ornamental cover rotatably mounted around the upper base in a tight fit manner to cover the upper base. The in-call indicator is mounted on the mobile phone by directly screwing the bolt of the lower base to an antenna of the mobile phone. In case the in-call indicator is mounted onto the mobile phone with the ornamental cover facing toward a direction not exactly the same as that of the mobile phone and therefore resulting in an inconsistent appearance, the ornamental cover may be adjusted in its direction simply by separating the upper base from the lower base and turn the upper base relative to the ornamental cover.

BRIEF DESCRIPTION OF THE DRAWINGS

The above and other objects of the present invention, and the technical means adopted by the present invention to achieve such objects can be best understood by referring to the following detailed description of the preferred embodiments and the accompanying drawings, wherein.

DETAILED DESCRIPTION OF THE PREFERRED EMBODIMENTS

Figure 1:
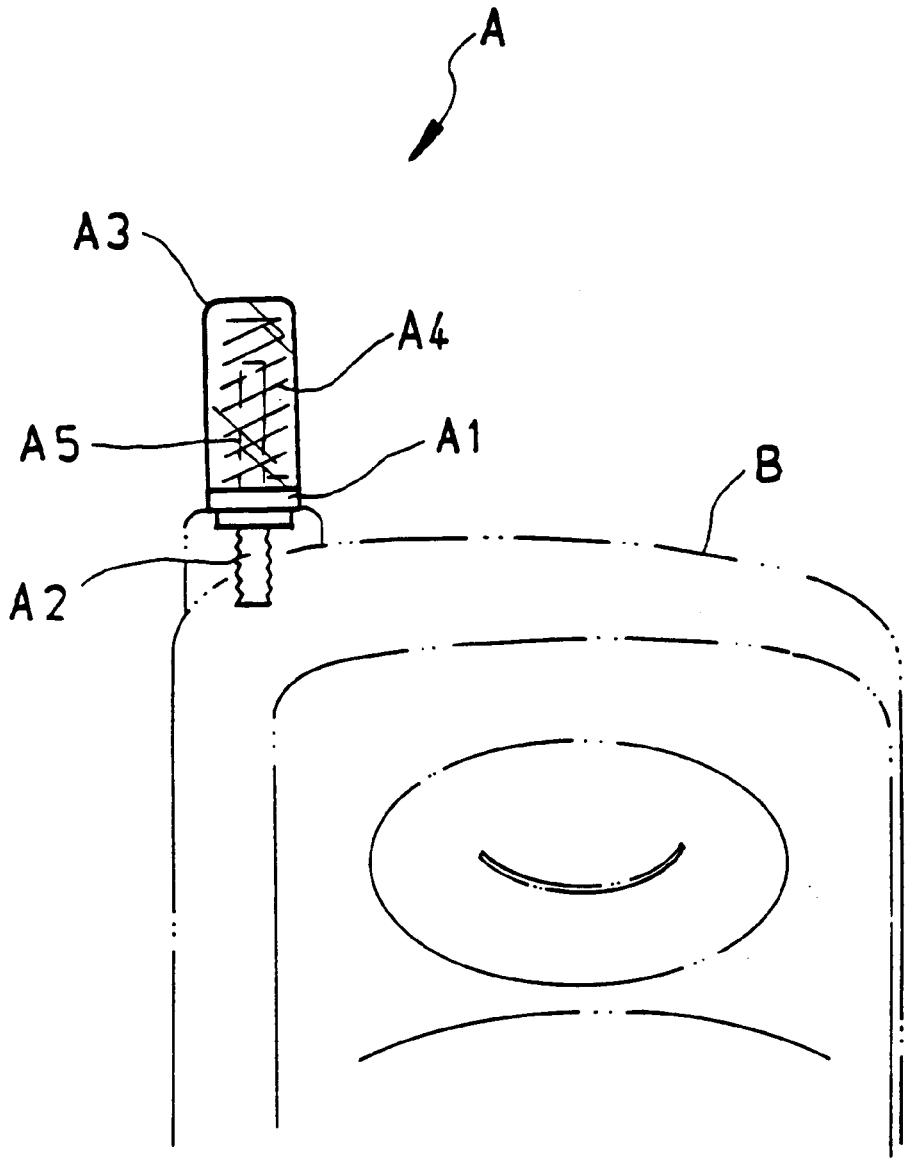
FIG. 1 PRIOR ART
FIG. 1 is a schematic sectional view of a conventional light-emitting antenna head for mounting on a mobile phone to indicate an in-coming call.
Figure 2:
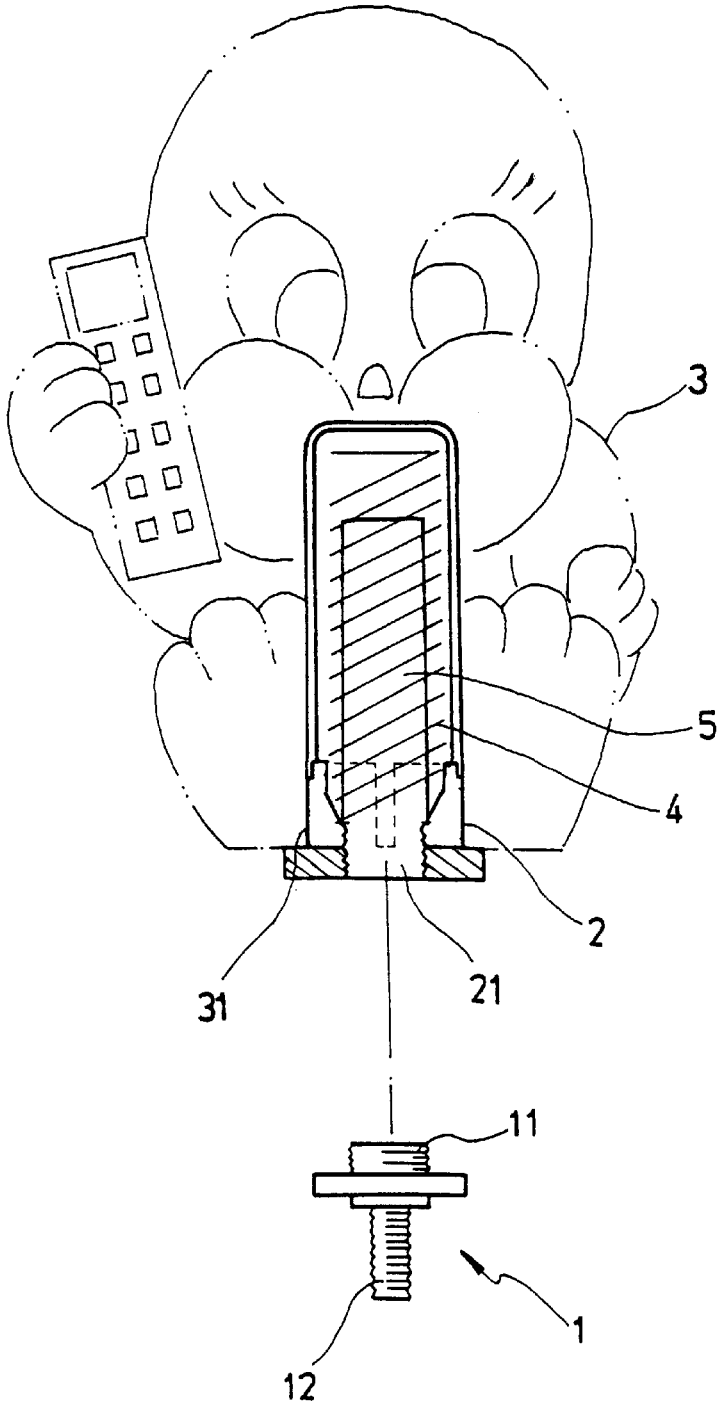
FIG. 2 is an exploded view showing members included in a mobile phone in-call indicator according to the present invention.

Please refer to FIG. 2 in which a mobile phone in-call indicator according to the present invention is shown in an exploded manner. As shown, the in-call indicator mainly includes a lower base 1, an upper base 2, an ornamental cover 3, a light-emitting diode 4, and a circuit board 5.

The lower base 1 is used to directly screw onto a mobile phone (not shown). The lower base 1 includes an externally threaded head 11 forming an upper part thereof and an externally threaded bolt 12 forming a lower part thereof.

The upper base 2 includes an internally threaded bottom hole 21 for receiving and engaging with the threaded head 11 of the lower base 1. The light-emitting diode 4 and the circuit board 5 are located and mounted on the upper base 2.

The ornamental cover 3 may be differently designed to show versatile shapes. A bottom of the cover 3 is provided with a receiving hole 31 for the upper base 2 to rotatably mount therein in a tight fit manner.

The light-emitting diode 4 and the circuit board 5 are connected to the upper base 2 during manufacture. The upper base 2 having the light-emitting diode 4 and the circuit board 5 connected thereto is then fitted into the cover 3 with the bottom of the upper base 2 abutting against an outer periphery of the receiving hole 31 of the cover 3.

Thereafter, the lower base 1 is connected to the upper base 2 by engaging the externally threaded head 11 with the internally threaded bottom hole 21 of the upper base 2 to complete a mobile phone in-call indicator of the present invention.

Figure 3:
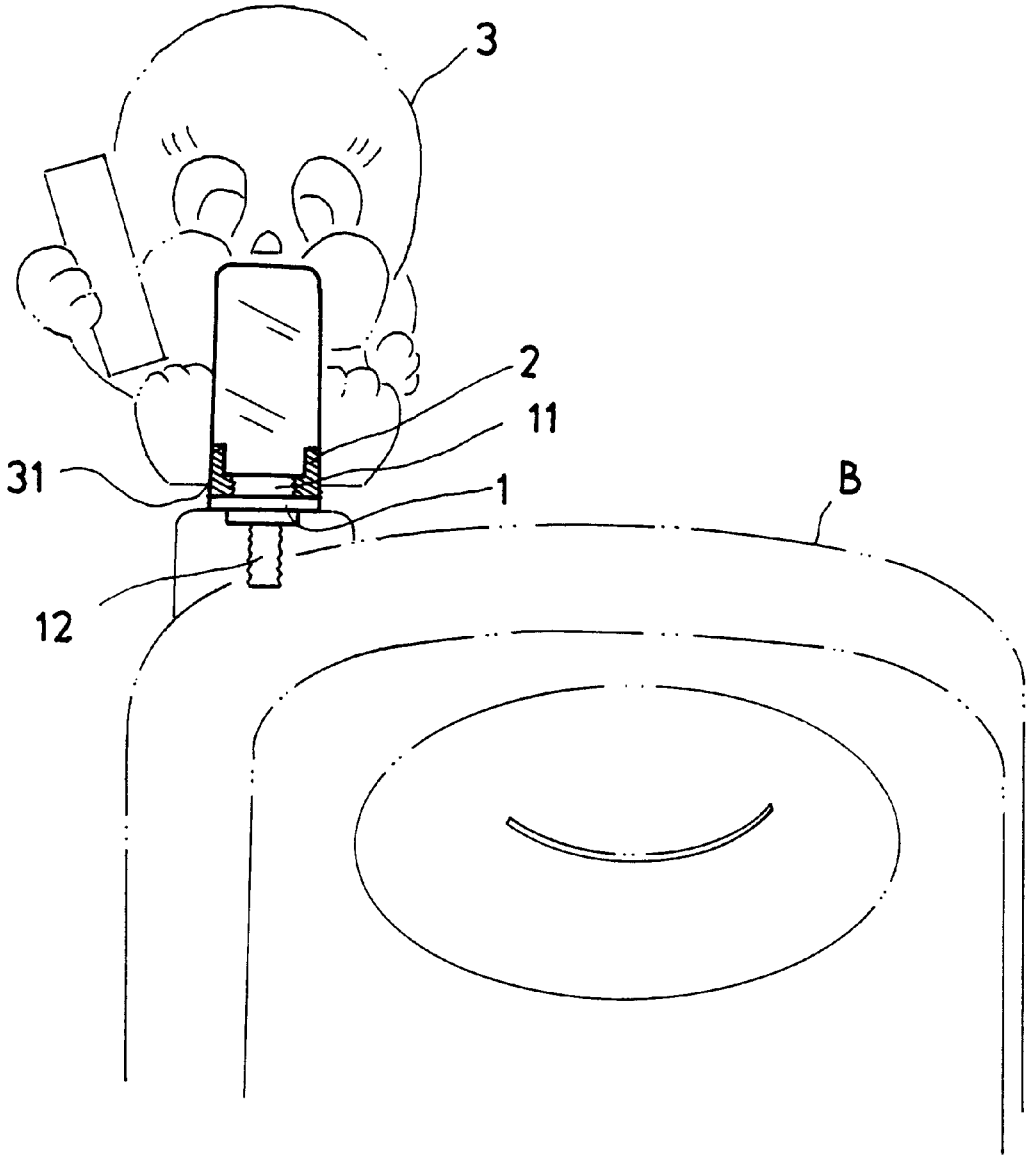
FIG. 3 illustrates the mounting of the mobile phone in-call indicator of the present invention onto a mobile phone.

Please now refer to FIG. 3. To mount the above mobile phone in-call indicator onto a mobile phone B, a user may hold it at the cover 3 and directly screw the bolt 12 at the lower part of the lower base 1 onto an antenna of the mobile phone B. After the lower base 1 is fully screwed into the mobile phone B, the cover 3 would usually face toward a direction the same as that of a front of the mobile phone B to show a consistent appearance.

In the event the cover 3 of the in-call indicator screwed onto the mobile phone B should face toward a direction not exactly the same as that of the front of the mobile phone B, the cover 3 may be adjusted in its direction by separating the upper base 2 from the lower base 1 and using a suitable tool to slightly turn the upper base 2 by a suitable degree relative to the cover 3. The adjusted upper base 2 and cover 3 may then be connected to the lower base 1 again. The adjusted in-call indicator remounted onto the mobile phone B would now face toward a direction the same as that of the mobile phone B.

With the above arrangements, the problem of an inconsistent and non-balanced appearance of the mobile phone caused by an angularly deviated in-call indicator due to an improper size thereof or an improper screwing force applied thereto can therefore be avoided. Meanwhile, the adjustment of the cover 3 does not require frequent loosening of the lower base 1 from the antenna of the mobile phone B, threads on the antenna can therefore have longer useable life.

What is claimed is:

1. A mobile phone in-call indicator comprising a lower base, an upper base, an ornamental cover, and a light-emitting diode and a circuit board mounted on said upper base; said mobile phone in-call indicator being characterized in that:

said lower base has an externally threaded bolt forming a lower part thereof for directly screwing onto a mobile phone, and an externally threaded head forming an upper part thereof; and that said upper base has an internally threaded bottom hole for engaging with said externally threaded head of said lower base; and that said ornamental cover may be differently designed but always has a receiving hole provided at a bottom for said upper base to rotatably mount therein in a tight fit manner while a bottom of said upper base abutting against an outer periphery of said receiving hole of said ornamental cover.

* * * * *